US007420345B2

(12) United States Patent
Menniger

(10) Patent No.: US 7,420,345 B2
(45) Date of Patent: Sep. 2, 2008

(54) CIRCUIT FOR DRIVING AN APPLIANCE FOR TREATING LAUNDRY

(75) Inventor: Ralf Menniger, Wangen (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 0 days.

(21) Appl. No.: 11/524,689

(22) Filed: Sep. 21, 2006

(65) Prior Publication Data

US 2007/0085503 A1 Apr. 19, 2007

(30) Foreign Application Priority Data

Oct. 17, 2005 (DE) ..... 10 2005 049 892

(51) Int. Cl.
*H02P 27/02* (2006.01)

(52) U.S. Cl. ..... 318/437; 388/917; 200/43.12; 70/174

(58) Field of Classification Search ..... 318/437, 318/445–446, 471–474; 388/907.2, 917; 307/112, 126, 139, 140, 141.8; 292/99; 68/12.16; 200/43.11, 43.12; 70/174, 442
See application file for complete search history.

(56) References Cited

U.S. PATENT DOCUMENTS

| | | | | |
|---|---|---|---|---|
| 3,597,943 | A * | 8/1971 | Gayring | 68/210 |
| 3,745,382 | A * | 7/1973 | Hoge et al. | 327/402 |
| 4,032,180 | A * | 6/1977 | Pohl | 292/341.16 |
| 4,074,545 | A * | 2/1978 | Case | 68/12.26 |
| 4,120,013 | A * | 10/1978 | Simmons | 361/180 |
| 4,194,182 | A * | 3/1980 | Martin | 340/310.18 |
| 4,198,563 | A * | 4/1980 | Elssner | 250/214 AL |
| 4,344,000 | A * | 8/1982 | Schornack et al. | 307/132 E |
| 4,349,748 | A * | 9/1982 | Goldstein et al. | 307/132 E |
| 4,493,410 | A * | 1/1985 | Nelson | 194/241 |
| 4,494,012 | A * | 1/1985 | Coker | 307/132 E |
| 4,623,179 | A * | 11/1986 | Davis et al. | 292/201 |
| 4,981,024 | A * | 1/1991 | Beldham | 68/12.18 |
| 5,655,394 | A * | 8/1997 | DiRocco, Jr. | 70/159 |
| 7,036,175 | B2 * | 5/2006 | Sears et al. | 8/158 |

FOREIGN PATENT DOCUMENTS

| | | |
|---|---|---|
| DE | 34 23 004 A1 | 1/1986 |
| DE | 199 53 633 A1 | 5/2001 |
| DE | 200 08 430 U1 | 10/2001 |
| EP | 0 702 103 A1 | 3/1996 |
| EP | 1 099 790 B1 | 5/2004 |
| GB | 2 048 314 A | 12/1980 |

* cited by examiner

*Primary Examiner*—Bentsu Ro
(74) *Attorney, Agent, or Firm*—Laurence A. Greenberg; Werner H. Stemer; Ralph E. Locher

(57) ABSTRACT

A circuit for driving an appliance for treating laundry, includes a motor circuit having an AC motor, and a door-locking circuit. The motor circuit and the door-locking circuit may be driven by a single common electronic switching element.

7 Claims, 4 Drawing Sheets

PRIOR ART

CIRCUIT FOR DRIVING AN APPLIANCE FOR TREATING LAUNDRY

CROSS-REFERENCE TO RELATED APPLICATIONS

This application claims the priority, under 35 U.S.C. §119, of German Patent Application DE 10 2005 049 892.2, filed Oct. 17, 2005; the prior application is herewith incorporated by reference in its entirety.

BACKGROUND OF THE INVENTION

Field of the Invention

The invention relates to a circuit for driving an appliance for treating laundry. The circuit has a motor circuit with an AC motor, and a door-locking circuit.

Circuits used to date for driving an appliance for treating laundry, such as a washing machine or a spin dryer, have a motor circuit and a door-locking circuit. It is possible for the two circuits to be driven separately from one another. The motor circuit has an AC commutator motor, which is regulated by a triac through the use of AC phase gating, for driving the washing drum. Furthermore, relays are connected in the motor circuit, through the use of which relays it is possible, on one hand, to reverse the direction of rotation of the motor and, on the other hand, which can interrupt the motor circuit, as is necessary, for example, in the event of a fault, i.e. in the event of an emergency shutdown. Through the use of the door-locking circuit, the loading opening or door of the washing machine or spin dryer is locked during the entire washing or spin-drying operation by a switch controlled by a PTC bimetallic element in order to rule out any possible danger to the user by coming into contact with the rotating drum. This PTC bimetallic element is continuously driven during the washing operation by a separate electronic or electromechanical switching element.

Such a circuit for driving an appliance for treating laundry having two circuits which are independent of one another for the motor and for locking the door may, given a corresponding construction, violate the provisions of the European Standard EN 60335-1 Article 19. In that case, an additional circuit is required for monitoring the door-locking circuit. Furthermore, two independent circuits require an increased amount of material, which goes directly against the absolute requirement for the domestic appliances industry, namely that of saving costs.

SUMMARY OF THE INVENTION

It is accordingly an object of the invention to provide a circuit for driving an appliance for treating laundry, which overcomes the hereinafore-mentioned disadvantages of the heretofore-known devices of this general type and which, on one hand, satisfies the need for reducing costs and, on the other hand, meets European specifications for domestic appliances with rotating drums.

With the foregoing and other objects in view there is provided, in accordance with the invention, a circuit for driving an appliance for treating laundry. The circuit comprises a motor circuit having an AC motor, a door-locking circuit, and a single common electronic switching element for driving the motor circuit and the door-locking circuit.

An appliance for treating laundry is understood to be a washing machine, a tumble dryer, a spin dryer, etc. The novel combination of the driving of the two electrical components of a washing machine which are completely different in terms of their function and driving, namely the washing motor and the door lock, with only one single common switching element, is made possible by the use of standard components which are provided in any case in any circuit for motor control in a washing machine. In this case, certain precisely defined sequences need to be taken into consideration when driving the two components.

In other words, a circuit for driving an appliance for treating laundry has a motor circuit and a door-locking circuit, the motor circuit and the door-locking circuit being connected to one another in such a way that the two circuits can be driven, i.e. supplied with current, jointly through a single common electronic switching element. Due to the omission of a dedicated switching element for the door-locking circuit, without replacement, savings can be made on production costs. Furthermore, the specifications of the European standard can be met easily.

In accordance with another feature of the invention, the door-locking circuit is switched on when driven through the single common electronic switching element, and it is possible for the motor circuit to be interrupted at the same time by at least one electromechanical switch.

The door-locking circuit is driven and switched on, i.e. supplied with current, due to the activation of the single common switching element. At the same time, the motor circuit is driven in addition to the door-locking circuit, due to the activation of the single common electronic switching element. At least one electromechanical switch is located in the motor circuit, through the use of which switch the motor circuit can be interrupted, i.e. can be switched in such a way that it has no current flowing through it.

Despite the fact that there is only one single common electronic switching element for the motor circuit and the door-locking circuit, the use of at least one electromechanical switch in the motor circuit ensures that the door locking required for safety reasons is activated before the washing drum is driven by the AC motor.

In accordance with a further feature of the invention, the single electronic switching element is a triac or a thyristor.

In accordance with an added feature of the invention, the door-locking circuit has a switch and/or a mechanism for locking the appliance door. The switch or mechanism can be driven by a PTC bimetallic element.

As a result of the fact that the door-locking circuit has a switch which can be driven by a PTC bimetallic element and/or a mechanism for locking the appliance door, it is ensured that, once the common electronic switching element has been switched off, i.e. the door-locking circuit has been switched such that no current is flowing through it, the mechanism for locking the appliance door remains locked for at least a further 30 seconds. In other words, even after only a short period of time in which current is flowing through the door-locking circuit, the locking mechanism remains closed for at least 30 seconds and the door cannot be opened. By the time it is possible to open the door, the washing drum in any case has come to a standstill without an additional electronic component being required to control it.

In accordance with an additional feature of the invention, there are provided two electromechanical switches in the motor circuit which are connected to the winding of the AC motor rotor or to the winding of the AC motor field and interrupt the motor circuit in a first switching state and bring about a reversal of the direction of rotation of the AC motor in a second switching state.

The direction of rotation of the AC motor can be reversed due to the change in the switching states. An electromechanical switch is understood to be relays or comparable components.

As a result of the different possibilities for disposition of the two electromechanical switches, it is ensured that structural variants are possible when wiring an appliance for treating laundry.

In accordance with a concomitant feature of the invention, the motor circuit has, in addition to the two electromechanical switches for reversing the direction of rotation of the AC motor and for interrupting the motor current, a further electromechanical switch for field reversal purposes. The electromechanical switch for field reversal purposes is connected to the respective other winding of the AC motor, i.e. not the winding which is connected to the two electromechanical switches for reversing the direction of rotation and interrupting the motor current.

Due to the further electromechanical switch in the motor circuit, it is ensured that field reversal is advantageously possible.

Other features which are considered as characteristic for the invention are set forth in the appended claims.

Although the invention is illustrated and described herein as embodied in a circuit for driving an appliance for treating laundry, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
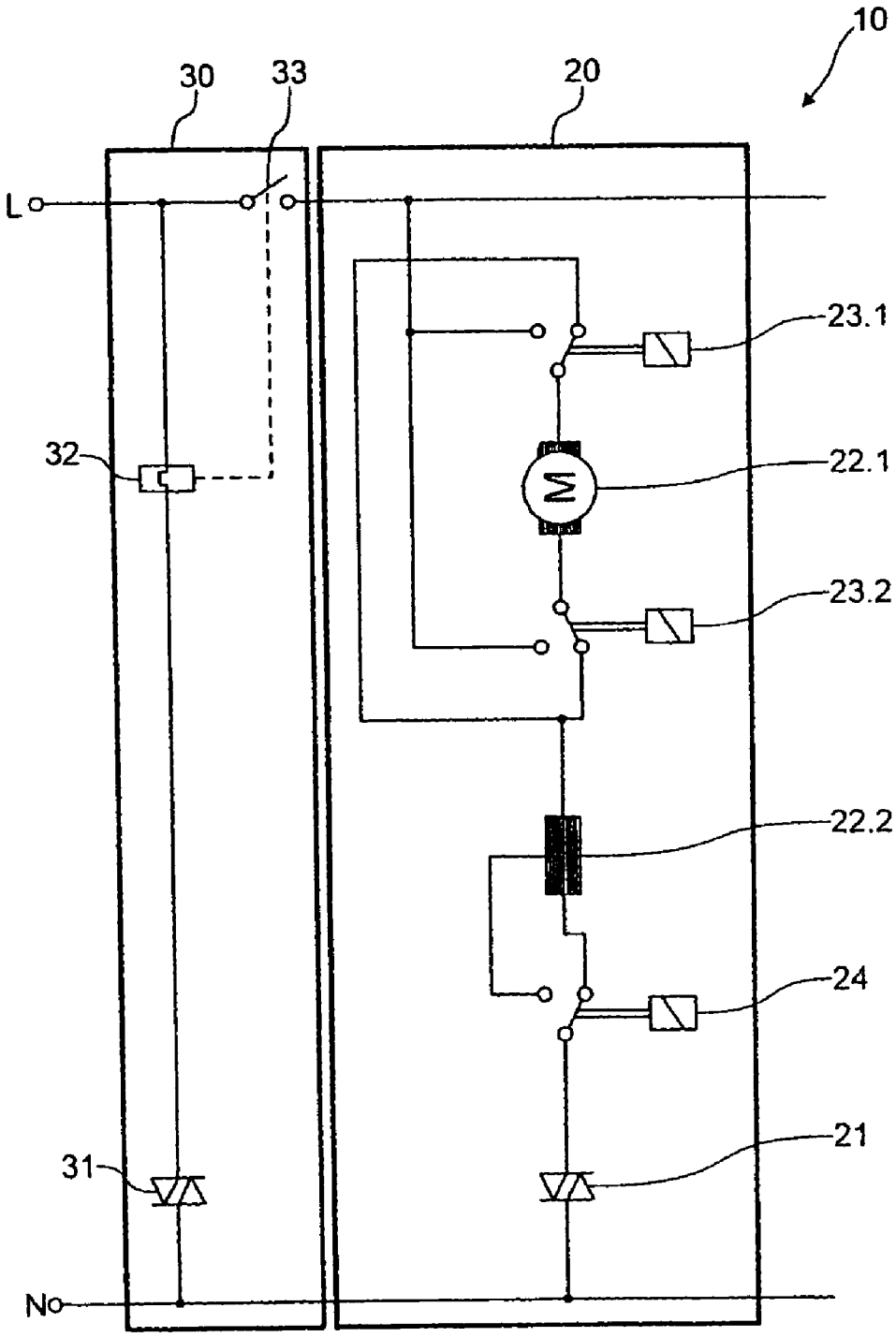
FIG. 1 PRIOR ART
FIG. 1 is a schematic diagram of a circuit for driving an appliance for treating laundry, in accordance with the prior art.

Referring now to the figures of the drawings in detail and first, particularly, to FIG. 1 thereof, there is seen a known circuit 10 for driving a washing machine, having a motor circuit 20 and a door-locking circuit 30. The motor circuit 20 has a triac 21, through which an AC washing motor 22 is driven or can have current applied thereto. The washing motor is switched on and off exclusively through the triac 21. In the present example, the ability of the washing motor 22 to have its direction of rotation reversed is implemented by the fact that two relays 23.1 and 23.2 are connected to a rotor winding 22.1 of the washing motor. An optional further relay 24 for field reversal purposes is disposed in a feed line to a field-inducing winding 22.2 of the washing motor. In addition to the possibility of reversing the direction of rotation of the washing motor 22, the relays 23.1 and 23.2 also make it possible to provide a current-free switchover 22.1 of the washing motor. However, the use of that option has until now not been known from the prior art.

The door-locking circuit 30, which is connected in parallel with the motor circuit 20, has a triac 31 which can be switched separately for the purpose of driving the door-locking circuit 30. Through the use of the triac 31 it is possible to apply current to a PTC bimetallic element 32, which causes the washing machine door to be locked. A door contact 33 is closed due to the washing machine door being locked. The door contact 33 ensures that the washing machine motor 22 only starts up and drives the washing drum in the event that the appliance door is locked in such a way that it cannot be opened and a risk of injury is ruled out.

Figure 2:
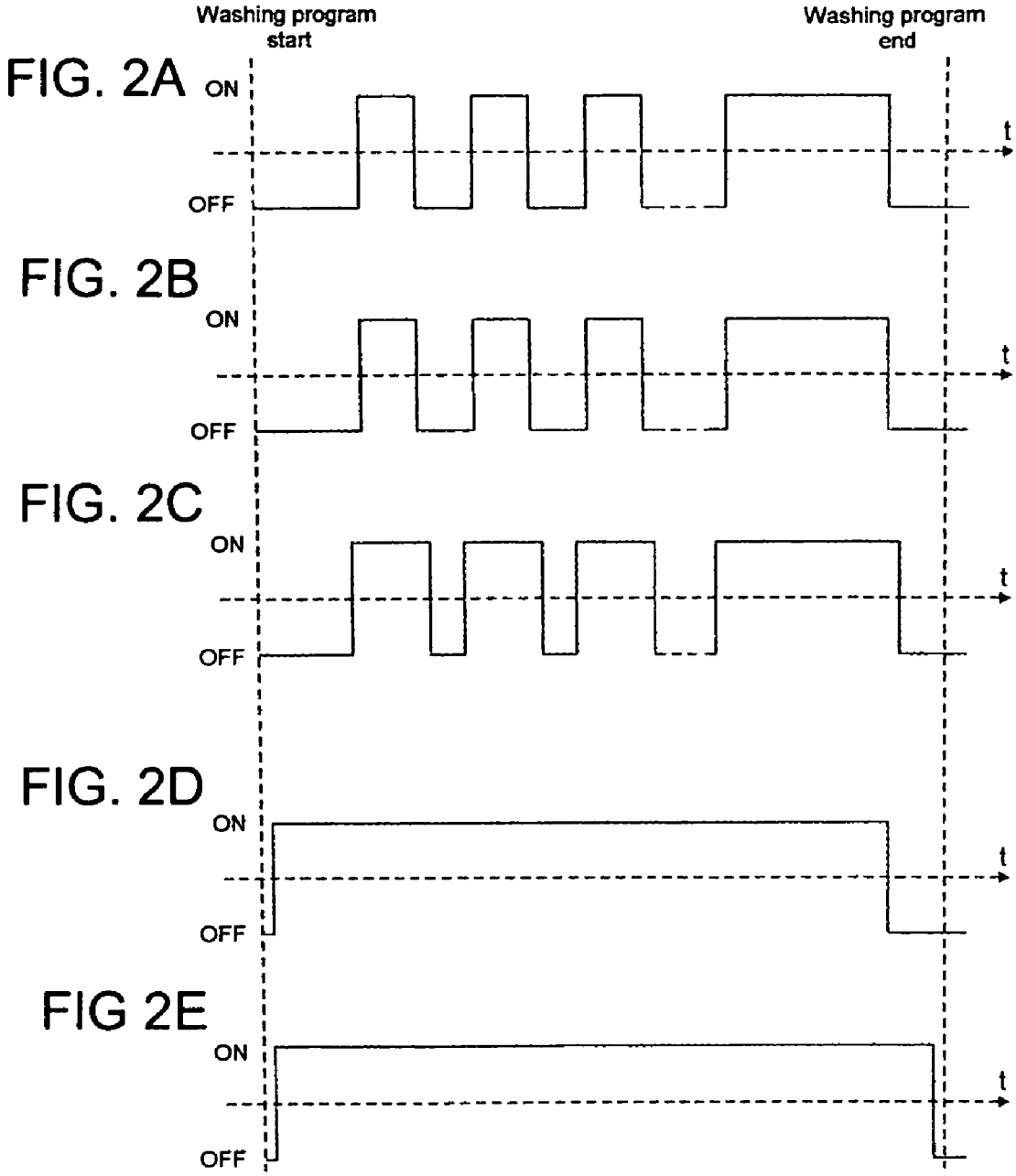
FIGS. 2A-2E are diagrams showing a time-dependent switching state in accordance with the prior art.

FIGS. 2A-2E show a profile of the switching state (activated—ON or deactivated—OFF) of the components in the motor circuit 20 and in the door-locking circuit 30, as a function of time. A washing program start is identified by a first vertical broken line, and a washing program end is identified by a second vertical broken line. FIGS. 2A, 2B and 2C concern components in the motor circuit 20, and FIGS. 2D and 2E concern components of the door-locking circuit 30.

A washing program begins by the triac 31 being driven after a certain time t and the triac 31 remaining activated up to the end of the washing operation, as shown in FIG. 2D. At the end of the washing operation, shortly before the end of the washing program, the triac 31 is switched in such a way that no current is flowing through it, i.e. the bimetallic locking element 32 no longer has any current applied to it.

Shortly after the activation of the triac 31, the PTC bimetallic element 32 reaches its operating temperature and locks the door lock, as is illustrated in FIG. 2E, even beyond the end of the washing operation, up to the end of the washing program. It is only at the end of the washing program that it is again possible to open the washing machine door.

Additional control software for compensating for the switching states of the switching elements 21 and 31 ensures that, as illustrated in FIG. 2A, the triac 31 is activated and the motor circuit 20 has current applied to it, only once the door lock has been locked by the PTC bimetallic element 32.

FIG. 2B shows that, once the triac 21 has been activated, it is possible to drive the washing drum through the use of the washing motor 22 if the relays 23.1 and 23.2 are located in such a switching position that the motor 22 is switched to be active (FIG. 2C). This is always the case in known circuit devices of the prior art.

An interruption to the washing motor movement (FIG. 2B) can be achieved by the triac 21 being deactivated (FIG. 2A). Once the washing operation has come to an end, or once the triac 21 has been deactivated for the last time (FIG. 2A) and the washing motor movement has thus come to an end (FIG. 2B), at the same time the triac 31 can be deactivated, which makes it possible to open the washing machine door at the end of the washing program, as mentioned, once at least 30 seconds of delay time have expired.

Figure 3:
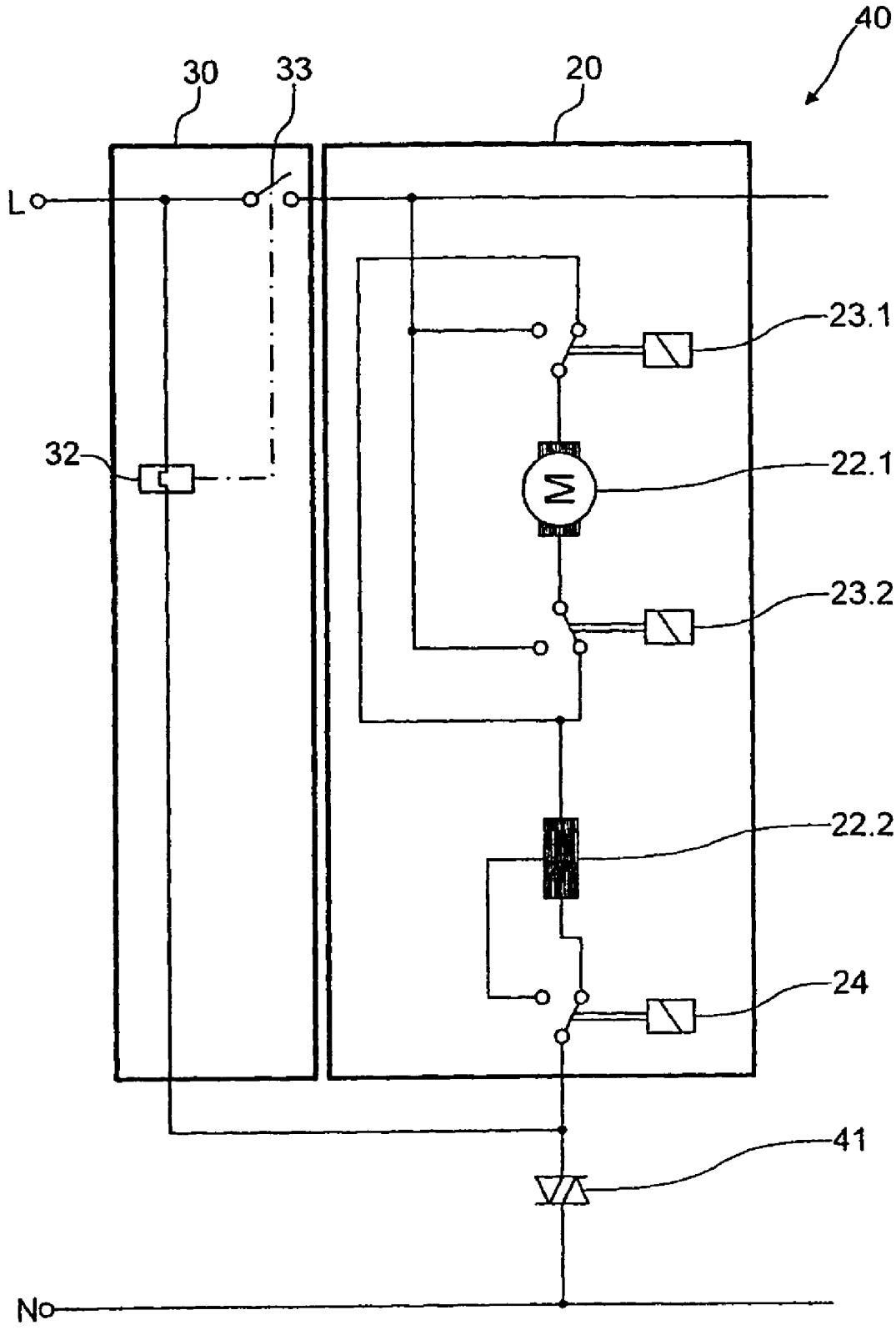
FIG. 3 is a schematic diagram of a circuit for driving an appliance for treating laundry, in accordance with the present invention.

FIG. 3 shows a circuit 40 corresponding to the concept of the present invention for driving a washing machine having a motor circuit 20 and a door-locking circuit 30, in which it is possible for current to be applied to the two circuits 20 and 30 through a single common electronic switching element 41, such as a triac.

The basic structure of the motor circuit 20 and the door-locking circuit 30 corresponds to the respective structure which has already been described for FIG. 1. Reference is therefore made to the description relating to FIG. 1. However, it would be possible for the two relays 23.1 and 23.2 to be connected to the field-inducing winding 22.2 of the washing motor for the purpose of providing the capability of reversing the direction of rotation or for the purpose of switching the motor off. The optional further relay 24 could also be connected to the rotor winding 22.1 of the washing motor. For example, a configuration is also possible in which one relay is only used for reversing the direction of rotation and one relay is only used for interrupting the motor circuit.

The important difference between the circuit 40 and the circuit 10 is the fact that, in the circuit 40, the door-locking circuit 30 is connected to the motor circuit 20 downstream of the single common electronic switching element 41. As a result, the motor circuit 20 and the door-locking circuit 30 can have current applied to them jointly, merely by a triac 41 being activated, or can be switched off jointly.

However, the simultaneous application of current to the motor circuit 20 and the door-locking circuit 30 can also be decoupled. This decoupling takes place by using the relays 23.1 and 23.2 and is an excellent feature of the present invention. This is because while the door-locking circuit 30 remains active, the washing motor 22 and therefore the drive of the washing drum can be switched off through the use of the relays 23.1 and 23.2. In this case, the washing machine door would remain locked, for example for reasons of safety, although the motor 22 has been switched off temporarily.

Figure 4:
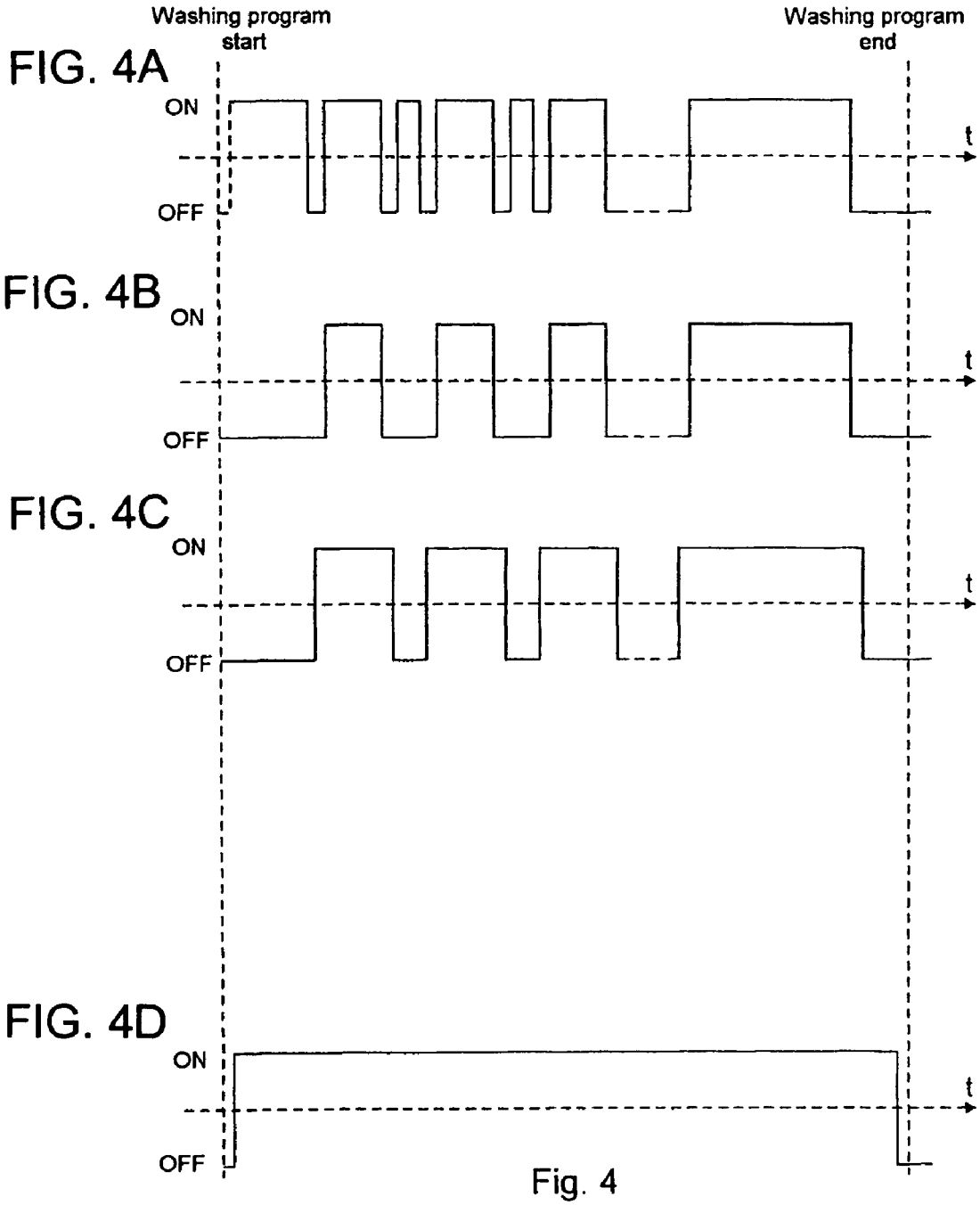
FIGS. 4A-4D are diagrams showing a time-dependent switching state in accordance with the present invention.

FIGS. 4A-4D illustrate a profile of the switching state (activated—ON or deactivated—OFF) of the components of the circuit 40 shown in FIG. 3 in the motor circuit 20 and in the door-locking circuit 30 as a function of time. The washing program start is identified by a first broken vertical line, and the washing program end is identified by a second broken vertical line. FIG. 4A concerns the switching element 41. FIGS. 4B and 4C concern components in the motor circuit 20. FIG. 4D concerns the door-locking circuit 30.

A washing program begins, after a certain time t, by the common triac 41 being driven, as shown in FIG. 4A.

Shortly after the activation of the triac 41, the PTC bimetallic element 32 reaches its operating temperature and locks the door lock, as is illustrated in FIG. 4D, even beyond the end of the washing operation up to the end of the washing program. It is only now that it is again possible to open the washing machine door.

Although current is applied at the same time to the door locking circuit 30 and the motor circuit 20, the washing drum is only driven by the washing motor 22 after a certain time, as is shown in FIG. 4B.

As is shown in FIG. 4C, this is associated with the fact that initially the relays 23.1 and 23.2 need to be switched on in order to allow a current flow through the washing motor 22. In other words, the current applied to the washing motor 22 can be interrupted by the relays 23.1 and 23.2 being switched.

In contrast to the known circuit (FIG. 1) the circuit shown in FIG. 3 does not require any additional control software, which monitors the switching state of the two switching elements 21 and 31. This is because current is applied to both the motor circuit 20 and the PTC bimetallic element 32 in the door-locking circuit 30 through the single control element 41, with the result that the washing machine door is always safely locked as long as the control element 41 is active.

An interruption in the washing motor movement (FIG. 4B) can be achieved, on one hand, by deactivating the triac 41 (FIG. 4A) or, on the other hand, by interrupting the current supply through the relays 23.1 and 23.2 (FIG. 4C). However, in order to protect the contacts of the relays 23.1 and 23.2, initially the motor circuit 20 (together with the door-locking circuit 30) is switched through the triac 41 in such a way that no current is flowing through it (FIG. 4A), the motor state is switched over in this switching state through the relays 23.1 and 23.2 (FIG. 4C) and then the current flow is connected again through the triac 41 (FIG. 4A). Consequently, the "switching spark" is produced on the triac 41, but not at the contacts of the relays 23.1 and 23.2.

As a result of the subsequent locking through the use of the PTC bimetallic element 32 in the door-locking circuit 30, the door lock remains locked up to the end of the washing operation (FIG. 4D), even if the switching element 41 should be deactivated for a short period of time during the washing operation (FIG. 4A). At the end of the washing operation, shortly before the end of the washing program, the triac 41 is switched permanently in such a way that no current is flowing through it until the subsequent locking is released and it is possible to open the door without any risk involved, since the washing drum has in the meantime come to a halt.

If the washing motor 22 needs to remain switched off for a relatively long period of time during the washing program, it is also possible for current to be applied to the door-locking circuit during the program by the triac 41 being switched on when the relays 23.1 and 23.2 are switched off without the motor being driven in the process (FIG. 4A).

I claim:

1. A circuit for driving an appliance for treating laundry, the circuit comprising:

a motor circuit having an AC motor;

a door-locking circuit connected in parallel to said motor circuit; and a single common electronic switching element for driving said motor circuit and said door-locking circuit.

2. The circuit according to claim 1, wherein said single common electronic switching element switches on said door-locking circuit when driven, and at least one electromechanical switch interrupts said motor circuit at the same time.

3. The circuit according to claim 1, wherein said single electronic switching element is a triac or a thyristor.

4. The circuit according to claim 1, wherein said door-locking circuit has at least one of a switch or a mechanism for locking an appliance door, and said at least one of a switch or a mechanism are to be driven by a FTC bimetallic element.

5. The circuit according to claim 1, which further comprises two electromechanical switches to be used in said motor circuit and connected to a rotor winding of said AC motor or to a field winding of said AC motor for interrupting said motor circuit in a first switching state and bringing about a reversal of direction of rotation of said AC motor in a second switching state.

6. The circuit according to claim 5, wherein said motor circuit additionally includes a further electromechanical switch relay for field reversal, said further electromechanical switch relay being connected to a winding of said AC motor not connected to said two electromechanical switches.

7. The circuit according to claim 1, wherein said door-locking circuit remains active to keep a door locked when said motor circuit switches off said motor.

* * * * *